US005977883A

United States Patent [19]

Leonard et al.

[11] Patent Number: 5,977,883

[45] Date of Patent: Nov. 2, 1999

[54] TRAFFIC LIGHT CONTROL APPARATUS FOR EMERGENCY VEHICLES

[76] Inventors: William H. Leonard; Roger D. Leonard, both of 4554 S. Hannibal St., Aurora, Colo. 80015

[21] Appl. No.: 08/903,464

[22] Filed: Jul. 30, 1997

[51] Int. Cl.[6] ..... G08G 1/07

[52] U.S. Cl. ..... 340/906; 340/902; 340/907; 340/917

[58] Field of Search ..... 340/906, 902, 340/904, 907, 916, 917, 924

[56] References Cited

U.S. PATENT DOCUMENTS

| | | | |
|---|---|---|---|
| 3,881,169 | 4/1975 | Malach | 340/906 |
| 4,135,144 | 1/1979 | Elmasian | 340/906 |
| 4,223,295 | 9/1980 | Bonner et al. | 340/906 |
| 4,228,419 | 10/1980 | Anderson | 340/906 |
| 4,704,610 | 11/1987 | Smith et al. | 340/906 |
| 4,775,865 | 10/1988 | Smith et al. | 340/906 |
| 4,914,434 | 4/1990 | Morgan et al. | 340/906 |

*Primary Examiner*—Jeffery A. Hofsass
*Assistant Examiner*—Van T. Trieu

[57] ABSTRACT

A new Traffic Light Control Apparatus for Emergency Vehicles for enabling control of a plurality of traffic signal lights disposed at a controlled intersection by an operator of an emergency vehicle and for disabling a conventional traffic signal light controller used for controlling the operation of the traffic signal lights. The inventive device includes a relay for disconnecting the conventional traffic signal light controller in response to a disconnect signal, a signal encoder disposed in the emergency vehicle for generating a plurality of signals, a transmitter for transmitting the signals, a data receiver disposed at the controlled intersection for receiving and decoding the signals and generating a plurality of input signals and for generating the disconnect signal, a state machine for accepting the input signals, for generating a plurality of state signals and for generating a plurality of output signals dependent upon the input signals and state signals, and a plurality of relays for energizing the traffic lights responsive to the output signals. An audible alarm located at the controlled intersection is activatable by the operator of the emergency vehicle.

9 Claims, 2 Drawing Sheets

44
46
DATA RX
RX
D0
D1
D2
D3
CARRIER DETECT
48
ROM
A0
A1
A2
A3
A4
A5
A6
D0
D1
D2
D3
D4
D5
D6
D7
D8
D9
D10
D11
D12
D13
D14
D15
R
Y
G
NORTH
WEST
SOUTH
EAST
47
49
D1
D2
D3
D4
Q1
Q2
Q3
Q4
D FF
51
52
OSC
÷
57
58
WHITE LIGHT
+V
56
53
54
55
DISCONNECT
64
+V
63
AUDIBLE SIGNAL
65
45
61
62

TRAFFIC LIGHT CONTROL APPARATUS FOR EMERGENCY VEHICLES

BACKGROUND OF THE INVENTION

1. Field of the Invention

The present invention relates to traffic light controllers and more particularly pertains to a new Traffic Light Control Apparatus for Emergency Vehicles for enabling control of a plurality of traffic signal lights disposed at a controlled intersection by an operator of an emergency vehicle and for disabling a conventional traffic signal light controller used for controlling the operation of the traffic signal lights.

2. Description of the Prior Art

The use of traffic light controllers is known in the prior art. More specifically, traffic light controllers heretofore devised and utilized are known to consist basically of familiar, expected and obvious structural configurations, notwithstanding the myriad of designs encompassed by the crowded prior art which have been developed for the fulfillment of countless objectives and requirements.

Known prior art traffic light controllers include U.S. Pat. No. 5,345,232; U.S. Pat. No. 5,014,052; U.S. Pat. No. 4,914,434; U.S. Pat. No. 4,443,783; U.S. Pat. No. 4,135,144 and U.S. Pat. No. 4,573,049.

While these devices fulfill their respective, particular objectives and requirements, the aforementioned patents do not disclose a new Traffic Light Control Apparatus for Emergency Vehicles. The inventive device includes a relay means for disconnecting the conventional traffic signal light controller in response to a disconnect signal, a signal encoding means disposed in the emergency vehicle for generating a plurality of signals, a transmitter means for transmitting the signals, a data receiver means disposed at the controlled intersection for receiving and decoding the signals and generating a plurality of input signals and for generating the disconnect signal, a state machine means for accepting the input signals, for generating a plurality of state signals and for generating a plurality of output signals dependent upon the input signals and state signals, and a plurality of relay means for energizing the traffic lights responsive to the output signals.

In these respects, the Traffic Light Control Apparatus for Emergency Vehicles according to the present invention substantially departs from the conventional concepts and designs of the prior art, and in so doing provides an apparatus primarily developed for the purpose of enabling control of a plurality of traffic signal lights disposed at a controlled intersection by an operator of an emergency vehicle and for disabling a conventional traffic signal light controller used for controlling the operation of the traffic signal lights.

SUMMARY OF THE INVENTION

In view of the foregoing disadvantages inherent in the known types of traffic light controllers now present in the prior art, the present invention provides a new Traffic Light Control Apparatus for Emergency Vehicles construction wherein the same can be utilized for enabling control of a plurality of traffic signal lights disposed at a controlled intersection by an operator of an emergency vehicle and for disabling a conventional traffic signal light controller used for controlling the operation of the traffic signal lights.

The general purpose of the present invention, which will be described subsequently in greater detail, is to provide a new Traffic Light Control Apparatus for Emergency Vehicles apparatus and method which has many of the advantages of the traffic light controllers mentioned heretofore and many novel features that result in a new Traffic Light Control Apparatus for Emergency Vehicles which is not anticipated, rendered obvious, suggested, or even implied by any of the prior art traffic light controllers, either alone or in any combination thereof.

To attain this, the present invention generally comprises a relay means for disconnecting the conventional traffic signal light controller in response to a disconnect signal, a signal encoding means disposed in the emergency vehicle for generating a plurality of signals, a transmitter means for transmitting the signals, a data receiver means disposed at the controlled intersection for receiving and decoding the signals and generating a plurality of input signals and for generating the disconnect signal, a state machine means for accepting the input signals, for generating a plurality of state signals and for generating a plurality of output signals dependent upon the input signals and state signals, and a plurality of relay means for energizing the traffic lights responsive to the output signals.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Traffic Light Control Apparatus for Emergency Vehicles apparatus and method which has many of the advantages of the traffic light controllers mentioned heretofore and many novel features that result in a new Traffic Light Control Apparatus for Emergency Vehicles which is not anticipated, rendered obvious, suggested, or even implied by any of the prior art traffic light controllers, either alone or in any combination thereof.

It is another object of the present invention to provide a new Traffic Light Control Apparatus for Emergency Vehicles which may be easily and efficiently manufactured and marketed.

It is a further object of the present invention to provide a new Traffic Light Control Apparatus for Emergency Vehicles which is of a durable and reliable construction.

An even further object of the present invention is to provide a new Traffic Light Control Apparatus for Emergency Vehicles which is susceptible of a low cost of manufacture with regard to both materials and labor, and which accordingly is then susceptible of low prices of sale to the consuming public, thereby making such Traffic Light Control Apparatus for Emergency Vehicles economically available to the buying public.

Still yet another object of the present invention is to provide a new Traffic Light Control Apparatus for Emergency Vehicles which provides in the apparatuses and methods of the prior art some of the advantages thereof, while simultaneously overcoming some of the disadvantages normally associated therewith.

Still another object of the present invention is to provide a new Traffic Light Control Apparatus for Emergency Vehicles for enabling control of a plurality of traffic signal lights disposed at a controlled intersection by an operator of an emergency vehicle and for disabling a conventional traffic signal light controller used for controlling the operation of the traffic signal lights.

Yet another object of the present invention is to provide a new Traffic Light Control Apparatus for Emergency Vehicles which includes a relay means for disconnecting the conventional traffic signal light controller in response to a disconnect signal, a signal encoding means disposed in the emergency vehicle for generating a plurality of signals, a transmitter means for transmitting the signals, a data receiver means disposed at the controlled intersection for receiving and decoding the signals and generating a plurality of input signals and for generating the disconnect signal, a state machine means for accepting the input signals, for generating a plurality of state signals and for generating a plurality of output signals dependent upon the input signals and state signals, and a plurality of relay means for energizing the traffic lights responsive to the output signals.

Still yet another object of the present invention is to provide a new Traffic Light Control Apparatus for Emergency Vehicles that is easily programmable.

Even still another object of the present invention is to provide a new Traffic Light Control Apparatus for Emergency Vehicles that is capable of being programmed to generate any desired sequence of traffic light signaling.

Still yet another object of the present invention is to provide a new Traffic Light Control Apparatus for Emergency Vehicles that enables the operator of the emergency vehicle to activate an audible signal disposed at the controlled intersection.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
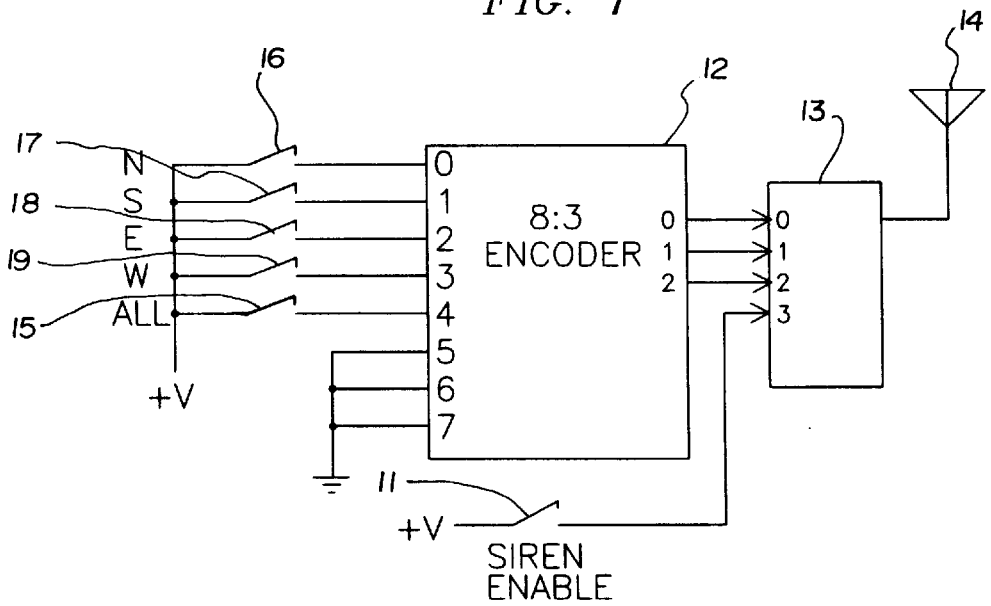
FIG. 1 is a schematic view of the signal encoding and transmitting circuit according to the present invention.
Figure 2:
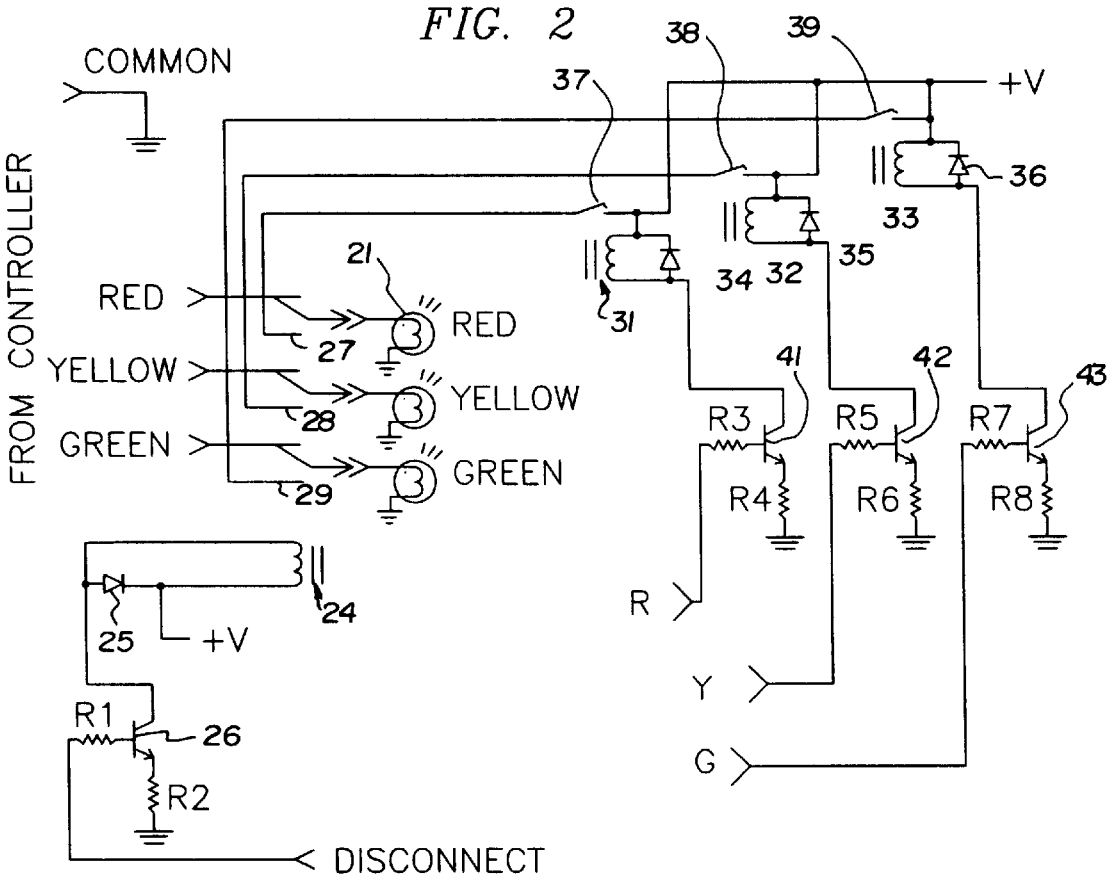
FIG. 2 is a schematic view of the traffic signal lights control switching circuit thereof.
Figure 3:
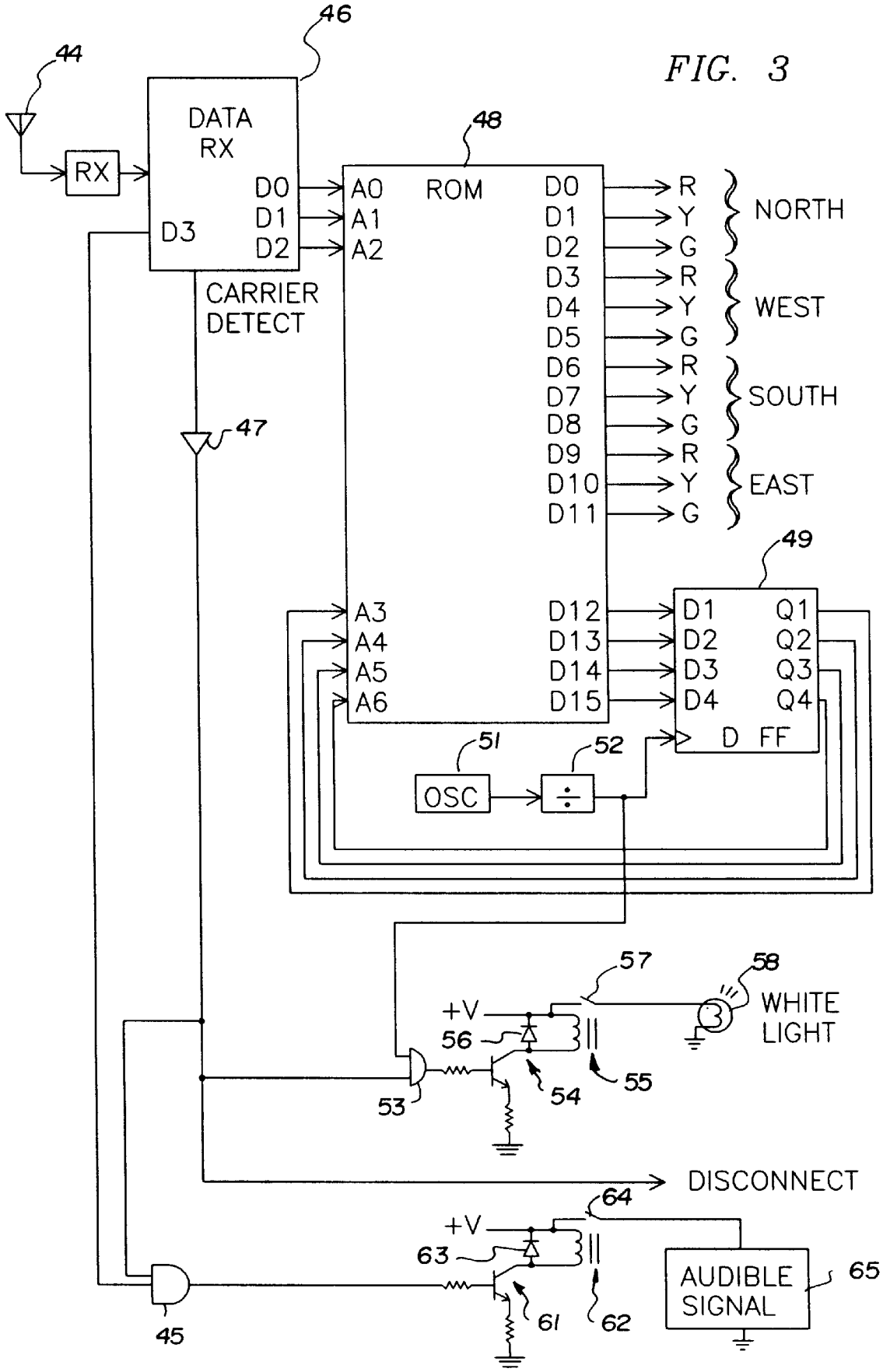
FIG. 3 is a schematic view of the data receiver, state machine and associated circuitry of the present invention.

With reference now to the drawings, and in particular to FIGS. 1 through 3 thereof, a new Traffic Light Control Apparatus for Emergency Vehicles embodying the principles and concepts of the present invention will be described.

More specifically, it will be noted that the Traffic Light Control Apparatus for Emergency Vehicles comprises a relay 24 for disconnecting the conventional traffic signal light controller, an 8:3 encoder 12 for generating a plurality of signals in response to the closing of switches 15–19, a transmitter 13 and antenna 14 for transmitting the signals, an antenna 44 and a receiver for receiving the signals, a data receiver 46 for decoding the signals and generating a plurality of input signals and for generating the disconnect signal, a Mealy state machine comprising a ROM 48, state register 49 and an oscillator/divider circuit 51,52, and relays 31–33 for energizing the traffic signal lights at the controlled intersection.

With reference to FIG. 1 there is shown an 8:3 encoder 12. In the preferred embodiment provision is made for five inputs to the 8:3 encoder 12. Closing switch 19 encodes a first signal representative of travel in a first direction of travel by the emergency vehicle which for purposes of illustration only is shown as a westerly direction. Closing switch 18 encodes a second signal representative of travel in a second direction of travel by the emergency vehicle which for purposes of illustration only is shown as a easterly direction. Closing switch 17 encodes a third signal representative of travel in a third direction of travel by the emergency vehicle which for purposes of illustration only is shown as a southerly direction. Closing switch 16 encodes a fourth signal representative of travel in a fourth direction of travel by the emergency vehicle which for purposes of illustration only is shown as a northerly direction. Closing switch 15 encodes a fifth signal, the response to which will be more fully described hereinafter.

With reference to the directions described above, it should be understood that the directional designations encompass a 90° range from the designated direction. Thus, as an example, the northerly designation represents the range from northwest to northeast.

With continued reference to FIG. 1, upon the closing of one of the switches 15–19, a tone is generated and transmitted by transmitter 13 and antenna 14. Additionally provision is made for the transmission of asixth signal representative of the operator's desire to activate an audible alarm such as a siren at the intersection. This is accomplished by means of closing a switch 11.

With reference to FIG. 3 there is shown an antenna 44 connected to a receiver. The transmitted tone is decoded by the data receiver 46 and a signal A0–A2 representative of the tone serves as an input signal to the Mealy state machine consisting of a 16-bit ROM 48, state register 49, and the clock circuit including an oscillator 51 and divider 52. Bits D0–D11 serve as output signals to twelve relay means similar to relay means 31–33 for energizing the traffic signal lights which energizes lights 21–23. Bits D12–D15 serve as inputs to the state register 49, implemented as a D flip-flop, whose output Q1–Q4 is fed to the ROM at inputs A3–A6 at each clock cycle.

The data receiver 46 also generates a Carrier Detect signal upon receipt of a valid tone. This signal is shown amplified and buffered by buffer amplifier 47 to generate the disconnect signal which turns on transistor 26 to energize relay 24 and disconnect the traffic signal lights 21–23 from the conventional traffic signal controller and connect the traffic signal lights 21–23 at contact points 27–29 (FIG. 2). Also shown is a blocking diode 25 for protecting transistor 26. If switch 11 is closed by the operator of the emergency vehicle, bit D3 goes high and is input along with the Carrier Detect signal to an AND gate 45 for turning on transistor 61 which activates a relay 62, closing contact arm 64 and thereby powering a siren 65 disposed at the controlled intersection. This feature would be advantageously used by police officers in their capacity as emergency response personnel as in the case of pursuit of a burglar or bank robbery suspect or while responding to a 911 emergency call.

As an example of a sequence that could be easily programmed into the ROM, an operator of an emergency vehicle traveling in a northerly direction would close switch 16 which would send the fourth signal. Upon being decoded and input to the ROM 48 as a decoded fourth signal, output word 001 100 100 100 0101 would cause the green light controlling northerly directed traffic to be energized while each of the red lights in the other directions of travel would be energized. The next state would be represented by the 4-bit word 0101, which would address the next output word and cause, for example, the green light to remain energized while the remaining traffic signal lights cycled through a sequence of yellow, green and back to red until such time as a valid tone was no longer being received by the data receiver 46. Provision is made for a default condition 0000 0000 0000 0000 which would allow control by the conventional traffic signal light controller.

In similar fashion, the ROM 48 is programmed to generate the output signal D0–D11 and next state signal D12–D15 for each of the first, second, third and fifth decoded signals. The fifth signal is shown as indicating that all of the traffic signal lights at the controlled intersection be made to sequence.

The oscillator 51 and divider 52 are chosen such that a clock signal is generated every 1–2 seconds to effect an easily perceptible sequence to approaching motorists.

With continued reference to FIG. 3 there is shown a light source 58, such as a white light visible from every approach to the controlled intersection, disposed at the controlled intersection to alert the operator of the emergency vehicle that the intersection is under the control of the control apparatus and that it is safe to proceed through the controlled intersection. Additionally the light source 58 alerts approaching motorists and operators of other emergency vehicles of the approach of an emergency vehicle to which they should give the right-of-way. A relay 55 is shown for closing contact arm 57 and connecting the light source 58 to the power supply. Also shown is a blocking diode 56 for protecting a transistor 54. For each clock cycle, the output of the AND gate 53 goes high thereby turning on the transistor 54 and energizing the relay 55 (assuming a Carrier Detect signal and control of the traffic signal lights has passed to the operator of the emergency vehicle). In this manner the light source 58 is made to flash.

With reference to FIG. 2 there is shown a relay 31 for connecting a red traffic signal light 21 at contact point 37, a relay 32 for connecting a yellow traffic signal light 22 at contact point 38 and a relay 33 for connecting a green traffic signal light 23 at contact point 39, the red traffic signal light 21, yellow traffic signal light 22 and green traffic signal light 23 being associated with control of a single direction of traffic. Not shown are additional relays and associated circuitry for connecting the traffic signal lights associated with control of the remaining directions of traffic although it is understood that the relays and associated circuitry are the same. Additionally, one skilled in the art can easily appreciate that additional relay circuits could easily be included to control other traffic signal lights such as WALK/DON'T WALK signals and turn arrows commonly found at controlled intersections. One skilled in the art can also easily appreciate that control of these additional traffic signal lights could easily be achieved with a sufficiently large ROM and wide enough state register.

With continued reference to FIG. 2 there is shown a transistor 41 for switching on relay 31. The transistor 41 is shown biased by resistors R3 and R4. A diode 34 is also shown associated with relay 31. A transistor 42 is shown for switching on relay 32. The transistor 42 is shown biased by resistors R5 and R6. A diode 35 is shown associated with relay 32. A transistor 43 is shown for switching on relay 33. The transistor 43 is shown biased by resistors R7 and R8. A diode 36 is shown associated with relay 33.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A Traffic Light Control Apparatus for Emergency Vehicles for enabling control of a plurality of traffic signal lights disposed at a controlled intersection by an operator of an emergency vehicle and for disabling a conventional traffic signal light controller used for controlling the operation of the traffic signal lights comprising:

a relay means for disconnecting the conventional traffic signal light controller, the relay means being responsive to a disconnect signal;

a signal encoding means for generating a first signal representative of a first direction of travel of the emergency vehicle, a second signal representative of a second direction of travel of the emergency vehicle, a third signal representative of a third direction of travel of the emergency vehicle, and a fourth signal representative of a fourth direction of travel of the emergency vehicle, the signal encoding means being disposed in the emergency vehicle;

a transmitter means for transmitting the first, second, third, and fourth signals, and for transmitting a sixth signal operable to activate an audible alarm disposed at the intersection, the transmitter means being operatively connected to the signal encoding means and disposed in the emergency vehicle;

a data receiver means for receiving and decoding the first, second, third, fourth and sixth signals and for generating the disconnect signal, the data receiver means being disposed at the controlled intersection;

a state machine means for accepting the decoded first, second, third, and fourth signals, for generating a plurality of state signals, and for generating a plurality of output signals dependent upon the decoded first, second, third, and fourth signals and the state signals; and a plurality of relay means for energizing the traffic lights responsive to the output signals.

2. The Traffic Light Control Apparatus for Emergency Vehicles of claim 1, wherein the signal encoding means for generating the first signal representative of the first direction of travel of the emergency vehicle, the second signal representative of the second direction of travel of the emergency vehicle, the third signal representative of the third direction of travel of the emergency vehicle, and the fourth signal representative of the fourth direction of travel of the emergency vehicle further comprise an 8:3 encoder.

3. The Traffic Light Control Apparatus for Emergency Vehicles of claim 1, wherein the data receiver means for receiving and decoding the first, second, third, fourth, and sixth signals and for generating the disconnect signal further comprise a data receiver.

4. The Traffic Light Control Apparatus for Emergency Vehicles of claim 3 further comprising an audible alarm operatively connected to the data receiver.

5. The Traffic Light Control Apparatus for Emergency Vehicles of claim 1 further comprising a flashing light source operably connected to the state machine means.

6. A Traffic Control Apparatus for Emergency Vehicles for enabling control of a plurality of traffic signal lights disposed at a controlled intersection by an operator of an emergency vehicle and for disabling a conventional traffic signal light controller used for controlling the operation of the traffic signal lights comprising:

a relay means for disconnecting the conventional traffic signal light controller, the relay means being responsive to a disconnect signal;

a signal encoding means for generating a plurality of signals, the signal encoding means being disposed in the emergency vehicle;

a transmitter means for transmitting the signals, the transmitter means being operatively connected to the signal encoding means and disposed in the emergency vehicle;

a data receiver means for receiving and decoding the signals and generating a plurality of input signals and for generating the disconnect signal, the data receiver means being disposed at the controlled intersection;

a state machine means for accepting the input signals, for generating a plurality of state signals, and for generating a plurality of output signals dependent upon the input signals and the state signals;

a plurality of relay means for energizing the traffic lights responsive to the output signals; and a flashing light source operably connected to the state machine means.

7. The Traffic Light Control Apparatus for Emergency Vehicles of claim 6, wherein the signal encoding means for generating the signals further comprise an 8:3 encoder.

8. The Traffic Light Control Apparatus for Emergency Vehicles of claim 6, wherein the data receiver means for receiving and decoding the signals and generating a plurality of input signals and for generating the disconnect signal further comprise a data receiver.

9. The Traffic Light Control Apparatus for Emergency Vehicles of claim 6 further comprising an audible alarm operatively connected to the data receiver means.

* * * * *